US005322647A

United States Patent [19]

Reiche et al.

[11] Patent Number: 5,322,647

[45] Date of Patent: Jun. 21, 1994

[54] OXYGEN BLEACHING OF COTTON LINTERS BY DISPROPORTIONATION OF HYDROGEN PEROXIDE

[75] Inventors: Angelika Reiche, Cologne; Joachim Behnke, Radevormwald; Hans-Dieter Brauer, Glashutten, all of Fed. Rep. of Germany

[73] Assignee: Akzo N.V., Netherlands

[21] Appl. No.: 790,358

[22] Filed: Nov. 12, 1991

[30] Foreign Application Priority Data

Nov. 10, 1990 [DE] Fed. Rep. of Germany ..... 4035813

[51] Int. Cl.[5] ..... D21C 9/147; D21C 9/16

[52] U.S. Cl. ..... 162/65; 8/111; 162/78; 162/95

[58] Field of Search ..... 162/95, 78, 90, 65, 162/79; 8/111

[56] References Cited

U.S. PATENT DOCUMENTS

| | | | |
|---|---|---|---|
| 2,119,519 | 6/1938 | Bragg et al. | 162/79 |
| 2,249,646 | 7/1941 | Bragg et al. | 162/79 |
| 4,384,970 | 5/1983 | Tourdot et al. | 252/99 |
| 4,400,237 | 8/1983 | Kruger et al. | 162/76 |
| 4,404,061 | 9/1983 | Cael | 162/76 |
| 4,427,490 | 1/1984 | Eckert | 162/78 |
| 4,614,646 | 9/1986 | Christiansen | 423/272 |
| 4,649,113 | 3/1987 | Gould | 162/78 |
| 4,661,205 | 4/1987 | Ow et al. | 167/78 |
| 4,810,408 | 3/1989 | Dubreux et al. | 252/99 |
| 4,859,283 | 8/1989 | Jayawant | 162/95 |
| 5,004,523 | 4/1991 | Springer et al. | 162/78 |

FOREIGN PATENT DOCUMENTS

| | | | |
|---|---|---|---|
| 2157077 | 8/1978 | Australia . | |
| 0034219 | 8/1981 | European Pat. Off. . | |
| 0272030 | 6/1988 | European Pat. Off. . | |
| 2340399 | 9/1977 | France . | |
| 2598727 | 11/1987 | France . | |
| 221483 | 9/1990 | Japan | 162/79 |
| 632967 | 12/1949 | United Kingdom . | |

OTHER PUBLICATIONS

Soteland, "Use of MgO or CuO as the Only Alkaline Source in Peroxide Bleaching", Int Pulp Bleach Conf. 1988.

Casey, *Pulp & Paper, vol. I*, 2nd Ed., Interscience Publishers, Inc., N.Y., p. 395 1960.

Scheller, Alien Property Custodian, Ser. No. 347,759, Jul. 13, 1943.

Chemical Abstract 98, 1983, 56052j.

Derwent Ref. 20639B/11 (Feb. 3, 1979).

*Primary Examiner*—Steve Alvo

*Attorney, Agent, or Firm*—Oliff & Berridge

[57] ABSTRACT

In a process for chlorine-free bleaching of cellulose with an α-cellulose content of more than 90%, preferably from boiled cotton linters, more than 75% whiteness is achieved in a single-stage process using oxygen. The bleaching is conducted using the oxygen obtained by disproportionation of peroxo compounds in the pH range from 6 to 13 and with the bleaching time, depending on the bleaching temperature of 35° C. to 15° C., being between 15 and 150 minutes.

5 Claims, No Drawings

OXYGEN BLEACHING OF COTTON LINTERS BY DISPROPORTIONATION OF HYDROGEN PEROXIDE

FIELD OF THE INVENTION

The invention relates to a process for chlorine-free bleaching of cellulose with an α-cellulose content of more than 90%, in which more than 75% whiteness is achieved using oxygen in a single-stage process.

BACKGROUND OF THE INVENTION

Bleaching using oxygen is already known, with the most important bleaching agents being hydrogen peroxide and sodium peroxide. Sodium perborate ($NaBO_3 \cdot 4H_2O$) is also of great importance, but has not been used in industrial bleaching for economic reasons; however, it has been used as a component of automatic detergents.

Peroxyacetic acid has posed handling difficulties in previous processes and has been used to a very limited extent for bleaching naphthol-dyed textiles. Potassium persulfate has also been proposed for bleaching as has sodium persulfate, as an additive in peroxide bleaching.

Molecular oxygen has likewise been used successfully as a bleaching agent in the MODO and SAPPI processes, with oxygen treatment taking place in the presence of NaOH at a temperature of approximately 100° C. To suppress over oxidation of the cellulose, $MgCO_3$ or complex manganese compounds are used.

Known bleaching processes using oxygen and peroxo compounds require temperatures of at least 100° C. and a generally highly alkaline medium generally produced by using alkali hydroxides.

Activation and stabilization are critical for the bleaching process.

The purpose of stabilization is to prevent radical decomposition of hydrogen peroxide and to render inactive any catalyst present which may promote this breakdown.

One stabilizer commonly employed in peroxide bleaching is water glass, often used in combination with magnesium salts. Other stabilizers include magnesium salts together with dispersing agents or complex formers. Other known stabilizers for hydrogen peroxide are phosphorus salts such as $Na_2H_2P_2O_7$.

Activation is effected by raising the temperature, alkalinity, and concentration. Activation begins and accelerates the bleaching process, but also favors the occurrence of undersirable side reactions, especially the breakdown of cellulose.

Disproportionation of peroxo compounds proceeds for $H_2O_2$ for example according to the following general reaction formula:

$$\begin{array}{lcccccccccc} \text{Oxidation Number} & +1 & -1 & -1 & +1 & & & +1 & -2 & +1 & \pm 0 & \pm 0 \\ & 2H & -0 & -0 & -H & \longrightarrow & & 2H & -0 & -H & + \underline{\overline{0}} & = \underline{\overline{0}} \end{array}$$

Two O atoms have increased their oxidation number by +1; two O atoms have reduced their oxidation number by −1.

The same is true for the disproportionation of peroxo acids, for example peroxoacetic acid.

$$\begin{array}{lcccccccccc} \text{Oxidation Number} & +1 & -1 & -1 & +1 & & & +1 & -2 & \pm 1 & \pm 0 & \pm 0 \\ & 2(CH_3-\underset{\underset{O}{\|}}{C}) & -0 & -0 & -H & \longrightarrow & & 2(CH_3-\underset{\underset{O}{\|}}{C}) & -0 & -H & + \underline{\overline{0}} & = \underline{\overline{0}} \end{array}$$

If disproportionation of the peroxo compounds does not take place through radicals, molecular oxygen is then released in a form which initiates oxidation reactions at low temperatures. As a result, oxygen form disproportionation which does not proceed through radicals permits a very protective form of oxidation, avoiding side reactions.

A chlorine-free multistage cellulose bleaching process is known form DE-OS 22 19 505, with at least three bleaching stages being used, with bleaching conducted using a peroxide in the first stage, a peracid in the second stage, and again, a peroxide in the third stage. This process uses neither chlorine nor water glass. NaOH is preferably used as the base, with the bleaching temperature being 20° to 140° C., preferably between 40° and the boiling point of the bleaching bath.

Under these conditions, decomposition to oxygen radicals also takes place, which then initiates largely uncontrolled oxidation by the oxygen radicals.

Bleaching which is completed in a short time with oxygen from disproportionation that does not proceed through radicals does not take place here. Bleaching times for each stage are four hours at about 70° C. and about 20 minutes at 100° C.

SUMMARY OF THE INVENTION

A goal of the present invention is to provide a bleaching process in which chlorine and hypochlorite can be completely eliminated and the reaction which gives off oxygen essentially forms no radicals and permits sufficient bleaching of cellulose with an α-cellulose content greater than 90% at low temperatures with short reaction times.

This and other goals are achieved according to the invention by a process characterized by the fact that bleaching is conducted with oxygen obtained by disproportionation of peroxo compounds in the pH range from 6 to 13, and the bleaching time, depending on the bleaching temperature, 35° C. to 15° C., is between 15 and 150 minutes.

DETAILED DESCRIPTION OF PREFERRED EMBODIMENTS

Boiled cotton linters are used as the primary raw material for producing dialysis membranes from regenerated cellulose. The process according to the invention is especially suitable for bleaching this cotton linters because of the protective bleaching action. Formerly, there was a danger of the products of side reactions from conventional bleaching processes entering the patient's blood during hemodialysis and triggering hypersensitivities in the patient. In one preferred embodiment of the process according to the invention, the cellulose with more than a 90% α-cellulose content is boiled cotton linters.

Preferred peroxo compounds are hydrogen peroxide and/or peroxo monosulfuric acid and/or peracetic acid and/or perborates, possibly in the form of their salts, each of which is accessible only within a narrow range of pH and temperature of disproportionation that does not take place through radicals, with catalysts being essential in the case of $H_2O_2$ and perborate.

Catalysts of this kind are preferably metal oxides and/or metal hydroxides of a metal of the second main group and/or the third, fourth, fifth or sixth subgroups of the periodic system of the elements. On the other hand, at room temperature, alkali hydroxides with $H_2O_2$ do not lead to the desired disproportionation reaction.

Calcium hydroxide has proven to be especially valuable as a catalyst in the process according to the invention for the desired disproportionation of hydrogen peroxide, although individuals skilled in the art of spinning would have expected problems with spinning using calcium hydroxide.

Relatively small amounts of metal oxides and/or metal hydroxides suffice for the method according to the invention. The weight ratio of hydrogen peroxide to metal oxide or metal hydroxide is preferably between 1:1 and 25:1.

Using the peroxo acids and their salts, disproportionation takes place in a very narrow pH range which depends on the pK value of the peroxo acid. Therefore the ratio of the pH value to the pK value of the peroxo acid is preferably 0.6 to 1.3. The molar ratio, based on a glucose unit, of the disproportionable oxygen to cellulose is about 1:5 to about 1:100.

To exclude most secondary and subsequent reactions during bleaching, the temperature range according to the invention is 15° to 35° C.

The invention will now be described in greater detail with reference to the following examples:

EXAMPLE 1

In a laboratory high-temperature boiler made by the Obermaier Company, 3.8 kg of boiled linters with DP 850 and an aqueous solution containing 0.02 wt. % $Ca(OH)_2$ and 0.15 wt. % $H_2O_2$ was bleached at a temperature of 30° C. The bath ratio of linters to bleaching medium was approximately 1:11. The reaction was stopped after 90 minutes. After removing the bleaching medium and washing the linters the reflectance of the cellulose was measured against $BaSO_4$ as a standard and was 76%.

EXAMPLE 2

In contrast to Example 1, bleaching was performed with an $H_2O_2$ concentration of 0.85 wt. % and a $Ca(OH)_2$ concentration of 0.13 wt. %. The reaction temperature was lowered to 20° C. After a reaction time of 90 minutes, bleaching was stopped and the reflectance of the linters, after washing, was found to be 78%.

EXAMPLE 3

In an enameled 600 liter reaction boiler provided with a stirrer, 7 kg of boiled linters were bleached in 300 l of an aqueous solution containing 0.85 wt. % $H_2O_2$ and 0.125 wt. % $Ca(OH)_2$ at 30° C. The bath ratio was 1:43. The pH value of the bleaching bath was 10.0. After 90 minutes reaction time the suspension was centrifuged off and washed. The reflectance of the bleached linters was 80%.

EXAMPLES 4 to 9

By analogy with Examples 1 to 3, further bleaching tests were conducted. The conditions and the results are summarized in Table 1:

| No. | Bleaching System | Concentration (wt %) | Reaction Temperature (°C.) | Bath Ratio 1: | pH of Bleach Bath | Reaction Time (Min) | Reflectance (%) |
|---|---|---|---|---|---|---|---|
| 4 | $H_2O_2/Ca(OH)_2$ | 0.85/0.125 | 30 | 21.4 | 10.2 | 90 | 81 |
| 5 | $H_2O_2/Ca(OH)_2$ | 0.29/0.125 | 30 | 37.5 | 9.9 | 90 | 77 |
| 6 | $CH_3COOOH$ | 0.15 | 30 | 40 | 8.2 | 90 | 76 |
| 7 | $2KHSO_5.KHSO_4.K_2SO_4$ | 3.1 | 20 | 33.3 | 9.4 | 60 | 79 |
| 8 | $2KHSO_5.KHSO_4.K_2SO_4$ | 3.1 | 20 | 30 | 9.4 | 60 | 82 |
| 9 | $2KHSO_5.KHSO_4.K_2SO_4$ | 3.1 | 20 | 42.8 | 9.4 | 60 | 80 |

No significant reduction of cellulose DP was observed in any of the examples.

What is claimed is:

1. A process for chlorine-free bleaching of cellulose, consisting of boiled cotton linters, with an α-cellulose content of more than 90%, in which more than 75% whiteness is achieved using oxygen in a single-stage process, wherein the bleaching is conducted with oxygen obtained by disproportionation of hydrogen peroxide, said disproportionation being catalyzed by at least one catalyst selected from the group consisting of an oxide and hydroxide of a metal of the second main group or the third, fourth, fifth or sixth subgroups of the periodic system of elements, in a pH range from about 6 to about 13 and for a bleaching time between about 15 and about 150 minutes, said bleaching time being dependent on a bleaching temperature which ranges from about 35° C. to about 15° C.

2. The process according to claim 1 wherein the catalyst is calcium hydroxide.

3. The process according to claim 1 wherein a weight ratio of hydrogen peroxide to the metal oxide or metal hydroxide is 1:1 to 25:1.

4. The process according to claim 1 wherein a ratio of a pH value to a pK value of the hydrogen peroxide ranges from about 0.6 to about 1.3.

5. The process according to claim 1 wherein a molar ratio, based on a glucose unit, of the disproportionable oxygen to cellulose is about 1:5 to about 1:100.

* * * * *

UNITED STATES PATENT AND TRADEMARK OFFICE

CERTIFICATE OF CORRECTION

PATENT NO. : 5,322,647

DATED : June 21, 1994

INVENTOR(S) : Angelika Reiche et al.

It is certified that error appears in the above-indentified patent and that said Letters Patent is hereby corrected as shown below:

Col. 2, line 17, change "form" to --from--;

line 22, change "form" to --from--.

Signed and Sealed this

Sixth Day of September, 1994

Bruce Lehman

*Attest:*

BRUCE LEHMAN

*Attesting Officer*

*Commissioner of Patents and Trademarks*